United States Patent [19]

Rowland

[11] Patent Number: 4,776,951

[45] Date of Patent: Oct. 11, 1988

[54] SCREENING APPARATUS FOR FIBER SUSPENSIONS

[75] Inventor: Stephen A. Rowland, Ste-Therese, Canada

[73] Assignee: Hymac Ltd., Quebec, Canada

[21] Appl. No.: 943,996

[22] Filed: Dec. 22, 1986

[30] Foreign Application Priority Data

Dec. 24, 1985 [CA] Canada ..... 498552

[51] Int. Cl.[4] ..... B07B 1/20

[52] U.S. Cl. ..... 209/273; 209/306; 209/379; 210/415; 366/320

[58] Field of Search ..... 209/273, 268, 305, 306, 209/300, 303, 304, 379, 270, 380, 384; 210/415, 380.7; 162/55; 366/320

[56] References Cited

U.S. PATENT DOCUMENTS

| | | | |
|---|---|---|---|
| 1,422,102 | 7/1922 | Hutchinson | 366/320 |
| 1,518,507 | 12/1924 | Hammond | 209/270 |
| 1,734,632 | 11/1929 | Merrill | 366/320 |
| 2,247,439 | 7/1941 | Hawes | 366/320 |
| 3,420,373 | 1/1969 | Hunter | 209/273 |
| 3,705,099 | 12/1972 | Hunter | 210/65 |
| 3,855,131 | 12/1974 | Thumberger | 209/306 |
| 4,001,119 | 1/1977 | Hunter | 210/402 |
| 4,188,286 | 2/1980 | Holz | 209/273 |
| 4,193,865 | 3/1980 | Aario | 209/273 |
| 4,328,096 | 5/1982 | Chupka et al. | 209/306 |

FOREIGN PATENT DOCUMENTS 137579 3/1902 Fed. Rep. of Germany ..... 209/306

*Primary Examiner*—Robert B. Reeves
*Assistant Examiner*—Donald T. Hajec
*Attorney, Agent, or Firm*—James W. Hellwege

[57] ABSTRACT

An improved screening apparatus for fiber suspensions is provided comprising at least one stationary, generally cylindrical screen drum into which the fiber suspension is fed having a central axis and a plurality of apertures through which rejectable material from the suspension cannot pass and is retained on a reject side of the drum and through which accepted fibers from the suspension can pass to an opposite side of the drum;

a generally cylindrical rotor, co-axial with the axis of the cylindrical screen drum;

the rotor supporting a series of blades arranged circumferentially about the rotor and substantially aligned with the longitudinal axis of the rotor, with the lateral extent of each blade being adjacent the surface of the cylindrical screen drum; and each blade in the series of blades having opposing ends and being inclined in the opposite direction to any adjacent blade relative to a line in the circumferential path of the blades which is parallel to the longitudinal axis of the rotor and the cylindrical screen.

6 Claims, 1 Drawing Sheet

SCREENING APPARATUS FOR FIBER SUSPENSIONS

Figure 1:
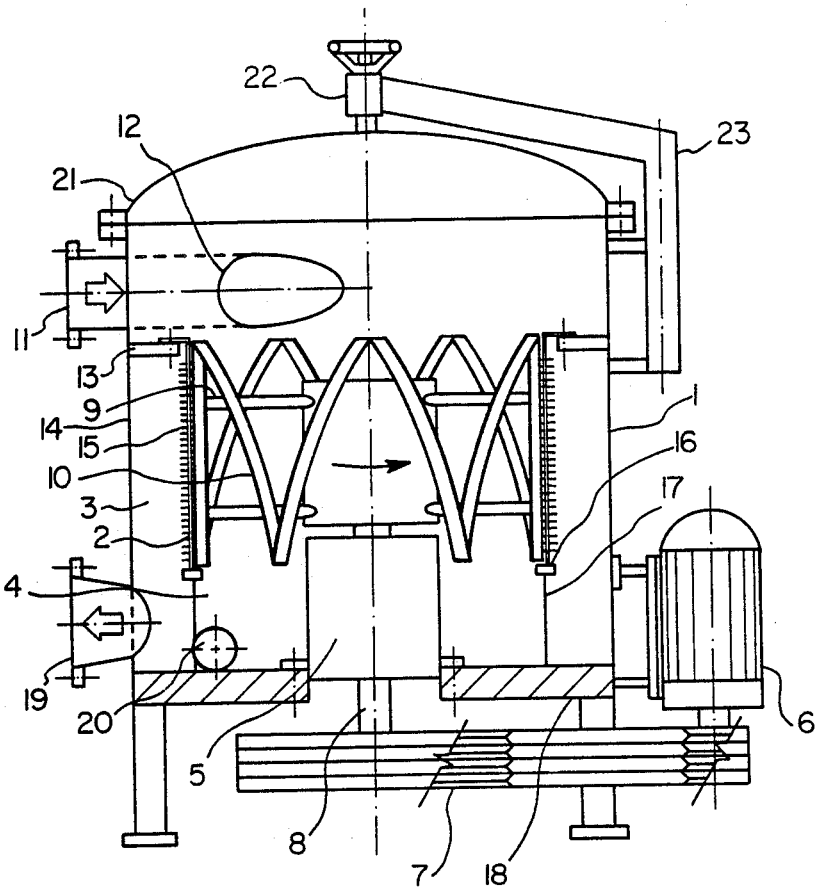

The present invention relates to a screening apparatus for fiber suspensions, and particularly pulp suspensions. The screening apparatus has one or more perforated screen drums which cause oversize and other contrary components of the suspension to remain on the feed side of the drum while allowing the accepted component of the suspension to pass through the drum. The invention relates in particular to a rotor assembly comprised of a rotor shaft, a rotor blade support and rotor blades for use with a screening apparatus. The rotor rotates about the axis of the screen drum and the blades rotate in close radial proximity to the screen drum. The cross-section of each blade is shaped in a known manner so as to generate hydraulic pressure waves to prevent the perforations in the screen drum from becoming clogged. The blades are arranged circumferentially about the rotor, each blade in the series of blades being inclined in the opposite direction to the preceding blade relative to a line on the cylindrical path of the blades parallel to the axis of the rotor and cylindrical screen.

Screening devices for fiber suspensions are well known. These devices are typically provided with one or more perforated screen drums. The fiber suspension is forced through the perforations whose size and shape can be chosen to suit the requirements of the particular application. The accept component passes through the screen drum and the reject component does not. In order to prevent clogging of the perforations, these devices are provided with rotors designed to generate hydraulic pressure waves at the surface of the screen drums. The means of creating these pressure waves and the arrangement of the screen drums have been the subject of many inventions.

In all previously known screening devices of this type, the rotors used to prevent clogging of the screen perforations create pressure fluctuations or pulsations in the accept flow of the device. The presence of pressure pulsations in the accept flow can be detrimental, for example when the screening device is upstream from a paper machine. The pressure pulsations can cause variations in the basis weight of the paper being manufactured.

Pressure pulsations are generated whenever there is a variation in the magnitude of the pressure waves imparted by the rotor. Several design features have been incorporated in screening devices in order to reduce the generation of pressure pulsations. Some previously known features include:

- use of hydrofoil shaped continuous blades to sweep the screen surface.
- careful attention to the concentricity of the blades and the screen.
- inclination of the blades relative to the axis of the drum.
- use of multiple blades.
- reduction of blade velocity.
- uniformity of the screen perforation pattern.
- blades located on the feed side of the screen drum.
- blades which do not pass either the feed or accept openings.
- smooth hydraulic flow paths within the screen chambers.

Various combinations of these measures have been employed in previously known screening devices and have, with varying degrees of success, reduced the severity of the pressure pulsations. Notwithstanding these improvements, detrimental pressure pulsations still occur. The frequencies of these pulsations are characteristically at the rotor rotation frequency and at the blade passing frequency. The blade passing frequency is derived by multiplying the rotor rotation frequency times the number of blades.

In previously known screening devices, the spacing and inclination of the rotor blades is constant, consequently at any point on a screen drum the period of time elapsed between blade passing is constant. This is the source of the characteristic vane passing frequency seen in the pulsation frequency spectrum. The pulsations generated at any particular point on the drum are always in phase and the sum of the pulsations is additive at a constant frequency.

The object of the present invention is to provide a rotor foil configuration which minimizes the generation of detrimental pulsations, without reducing the effectiveness of the screen cleaning action.

According to the present invention, there is now provided a screening device in which the blades of the rotor assembly are alternately inclined in the opposite direction relative to a line parallel to the axis of the rotor on the cylindrical path defined by the rotation of the blades. The alternating inclination of the rotor blades relative to a line parallel to the axis of the screen drums on the circumference of the path established by the blades of the rotor minimizes the generation of pulsations due to irregularities on the surface of the drum or due to variations in the distance between the drum and the blades. The zig-zag pattern of the blades ensures that the time period between blade passing is not constant which further contributes to the reduction of pulsation levels in the accept flow.

The invention is described below in more detail with reference to the drawings:

FIG. 1 depicts a side elevation, partially as a cross-section, of one embodiment of the screening apparatus for fiber suspension.

Referring to FIG. 1 the screening apparatus is comprised of a generally cylindrical enclosed vessel 1 having a partially screened separation wall 2 dividing the vessel into a circumferential accepted stock area 3 and a lower interior rejected stock area 4. Centrally disposed in the vessel is a rotor assembly 5 attached to motor 6 by means of a belt drive 7. The rotor assembly 5 is comprised of a rotor shaft 8, rotor supports 9 and rotor blades 10.

The vessel 1 includes an inlet pipe 11 having a tangential inlet 12 into the top of the vessel 1, a partially screened separation wall 2 comprised of upper support wall 13 extending inwardly from exterior wall 14 of vessel 1, a removable screen drum 15 mounted on said upper support wall 13 sits firmly on lower support ring 16 mounted on continuous interior wall 17 fixed to the bottom 18 of vessel 1 and extending vertically upward from the bottom 18. The circumferential accepted stock area 3 is bounded by upper support wall 13, screen drum 15, ring 16, interior wall 17 and the interior of exterior wall 14 of vessel 1. An accepted stock outlet 19 is formed through the exterior wall 14 proximate to the bottom 18 of vessel 1.

The lower interior rejected stock area 4 is bounded by the bottom 18, the interior wall 17, and the support ring 16 and the lower portion of rotor assembly 5. The lower interior rejected stock area includes a rejected stock outlet 20 which passes through the interior wall 17 and exterior wall 14.

The vessel 1 is enclosed by a cover 21. The cover 21 is threadably connected to swinging support arm 23 for lifting and swinging the cover into or out of place for maintenance or repair.

In operation the fiber suspension is introduced into vessel 1 through inlet pipe 11 and tangential inlet 12. The bulk of the fiber suspension flows through screen drum 15 into the accepted stock area 3 and is removed from the vessel 1 through accepted stock outlet 19. Portions of the fiber suspension which are unable to pass through flow screen drum 15 fall to interior rejected stock area 4. The rotor shaft 8, rotor supports 9 and rotor blades 10 are continually turning in order to keep the flow screen drum 15 clear of rejected stock. The lower interior rejected stock area 4 is cleared by opening rejected stock outlet 20 as required.

In some screening apparatus the fiber suspension to be cleaned can be fed around the exterior of the screen drum and the accept stock may be removed from the inside of the screen drum. A plurality of screen drums may be employed. The means used to support the rotor blades may be top and bottom circumferential supports or horizontal intermediary supports extending from the rotor shaft to the rotor blades. Various modifications may be constructed or performed within the scope of the inventive concept disclosed. Therefore what has been set forth is intended to illustrate such concept and is not for the purpose of limiting protection to any herein particularly described embodiment thereof.

The embodiments of the invetnion in which an exclusive property or privilege is claimed are defined as follows:

1. An improved screening apparatus for fiber suspensions comprising:

at least one stationary, generally cylindrical screen drum having a central axis and a plurality of apertures through which rejectable material from the fiber suspension cannot pass and is retained on a reject side of the drum and through which accepted fibers from said fiber suspension can pass to an opposite side of the drum;

means for supporting said drum;

means for feeding the fiber suspension to the reject side of the said drum;

means for removing accepted fibers from the opposite side of the said drum;

means for removing the rejected material;

means for generating pressure waves to detach fibers and other solids from the screen drum surface;

said means for pressure wave generation comprising a generally cylindrical rotor, co-axial with the axis of the cylindrical screen drum;

said rotor supporting a series of blades arranged circumferentially about the rotor and substantially aligned with the longitudinal axis of the rotor, with the lateral extent of each blade being adjacent the surface of the cylindrical screen drum;

each blade in said series of blades having opposing ends and being inclined in the opposite direction to any adjacent blade relative to a line in the circumferential path of the blades which is parallel to the longitudinal axis of the rotor and the cylindrical screen.

2. The screening apparatus for fiber suspensions of claim 1 wherein each blade is joined at each end to the adjacent blades.

3. The screening apparatus of claim 1 wherein said blades are vertically oriented.

4. An improved rotor assembly for a cylindrical screening apparatus including a cylindrical screen to selectively pass fibers in a filter suspension, the rotor assembly comprising a rotor having a longitudinal axis, supports extending from said rotor, and blades circumferentially arranged about said rotor and substantially aligned with the longitudinal axis of the rotor attached to said supports, said supports serving to position the lateral extent of said blades proximate the cylindrical screen, each blade being inclined in the opposite direction to adjacent blades relative to a line in the circumferential path of said blades which is parallel to the longitudinal axis of the rotor.

5. The improved rotor assembly of claim 4 wherein each blade is joined at each end to the adjacent blades.

6. The improved rotor assembly of claim 4 wherein said blades are vertically oriented.

* * * * *